US009022795B2

(12) United States Patent
Elsaesser et al.

(10) Patent No.: US 9,022,795 B2
(45) Date of Patent: May 5, 2015

(54) PLUG ARRANGEMENT FOR CONNECTING ELECTRICAL CONDUCTORS WITH AN ELECTRICAL ASSEMBLY

(71) Applicant: Weidmueller Interface GmbH & Co. KG, Detmold (DE)

(72) Inventors: Sven Elsaesser, Detmold (DE); Stephan Schabbehard, Lage (DE); Reinhard Nolting, Detmold (DE)

(73) Assignee: Weidmueller Interface GmbH Co. KG, Detmold (DE)

( * ) Notice: Subject to any disclaimer, the term of this patent is extended or adjusted under 35 U.S.C. 154(b) by 69 days.

(21) Appl. No.: 14/051,046

(22) Filed: Oct. 10, 2013

(65) Prior Publication Data

US 2014/0106596 A1 Apr. 17, 2014

(30) Foreign Application Priority Data

Oct. 17, 2012 (DE) ..... 20 2012 103 985 U

(51) Int. Cl.

| | |
|---|---|
| ***H01R 4/50*** | (2006.01) |
| ***H01R 13/627*** | (2006.01) |
| ***H01R 9/24*** | (2006.01) |
| ***H01R 13/639*** | (2006.01) |
| ***H01R 35/04*** | (2006.01) |

(52) U.S. Cl.

CPC ..... *H01R 13/627* (2013.01); *H01R 9/24* (2013.01); *H01R 13/639* (2013.01); *H01R 35/04* (2013.01)

(58) Field of Classification Search

CPC ..... H01R 13/629

USPC ..... 439/341, 376, 352

See application file for complete search history.

(56) References Cited

U.S. PATENT DOCUMENTS

2010/0081313 A1 * 4/2010 Komiyama et al. ..... 439/341

FOREIGN PATENT DOCUMENTS

| | | |
|---|---|---|
| DE | 197 44 662 C1 | 6/1999 |
| DE | 10 2011 051 154 A1 | 2/2012 |
| DE | 20 2011 000 686 U1 | 3/2012 |

* cited by examiner

*Primary Examiner* — Phuong Dinh

(74) *Attorney, Agent, or Firm* — Lawrence E. Laubscher, Sr.; Lawrence E. Laubscher, Jr.; Robert D. Spendlove

(57) ABSTRACT

A connector arrangement for connecting the bare ends of a plurality of insulated conductors to a horizontal row of first contacts arranged on an electrical device, respectively, including a main housing having a side portion containing a chamber in which the electrical device is mounted, a connector housing pivotally connected with the main housing for pivotal movement about a vertical pivot axis between engaged and disengaged positions, the connector housing supporting a horizontal row of conductor contacts arranged to engage the first contacts when the contact housing is in the engaged position, and a manually-operable locking arrangement for locking the connector housing in the engaged position. The locking arrangement includes a locking projection fixed to the main housing, a catch member movably connected with the connector housing, and an actuating member for displacing the catch member between locked and unlocked positions relative to the locking projection.

10 Claims, 5 Drawing Sheets

PLUG ARRANGEMENT FOR CONNECTING ELECTRICAL CONDUCTORS WITH AN ELECTRICAL ASSEMBLY

REFERENCE TO RELATED APPLICATIONS

This application claims priority of the German application No. DE 20 2012 103 985.0 filed Oct. 17, 2012.

BACKGROUND OF THE INVENTION

1. Field of the Invention

A connector arrangement for connecting the bare ends of a plurality of insulated conductors to a horizontal row of first contacts arranged on an electrical device, respectively, including a main housing having a side portion containing a chamber in which the electrical device is mounted, a connector housing pivotally connected at one end with the main housing for pivotal movement about a vertical pivot axis between engaged and disengaged positions, the connector housing supporting a horizontal row of conductor contacts arranged to engage the first contacts, respectively, when the contact housing is in the engaged position, and a manually-operable locking arrangement for locking the connector housing in the engaged position.

2. Description of Related Art

In the field of production engineering, it is very important to make sure that the connections of electrical instruments will contact securely also in response to vibration stress. On the other hand, the instruments used for manufacturing must frequently be reconfigured during the change of finished products, something that can also demand an adaptation of the electrical connections.

There is therefore a great need for connector arrangements that can be used in a modular fashion, that are easily reconfigurable, and that furthermore guarantee a great measure of functional reliability during sustained operation.

The present invention was developed to provide a connector arrangement for respectively connecting a plurality of electrical conductors to the contacts of an electrical device or subassembly, and that will meet the abovementioned requirements.

SUMMARY OF THE INVENTION

Accordingly, a primary object of the present invention is to provide a connector arrangement for connecting the bare ends of a plurality of insulated conductors to a horizontal row of first contacts arranged on an electrical device, respectively, including a main housing having a side portion containing a chamber in which the electrical device is mounted, and a connector housing having a first end pivotally connected with the main housing for pivotal movement about a vertical pivot axis between closed engaged and open disengaged positions, the connector housing supporting a horizontal row of second contacts arranged to engage the first contacts when the contact housing is in the closed engaged position, together with manually-operable locking means being provided for locking the connector housing in the engaged position.

According to a more specific object of the invention, the locking means includes a locking projection fixed to the main housing, a catch member movably connected with the connector housing, and an actuating member for displacing the catch member between locked and unlocked positions relative to the locking projection.

Another object of the invention is to provide as the actuating member a slide member that is manually displaceable transversely of the connector housing between inserted locking and withdrawn unlocking positions. The slide member includes a first ramp surface that cooperates with a fixed ledge on the connector housing to pivot the slide member, as it is inserted toward the locking position, to displace the catch member toward its locked position. The slide member also includes a second ramp surface that cooperates with the projection on the main housing to pivot the slide member to displace the contact member toward its unlocked position relative to the locking projection.

The connector arrangement serves to connect the bare ends of a plurality of electrical conductors with the contacts of an electrical device or subassembly, such as a printed circuit board, mounted in a chamber contained in a main housing. A connector housing is pivotally connected at one end with the main housing for displacement about a vertical pivot axis between disengaged and engaged positions, said connector housing having a horizontal longitudinal row of conductor contacts that are connected at one end with corresponding contacts arranged in a horizontal longitudinal row on the printed circuit board when the connector housing is pivoted to the engaged position. Screw terminals or the like connect the other ends of the conductor contacts with the bare ends of the insulated conductors, respectively. Locking means including a manually-operable transversely-displaceable slide member serve to lock together the main and connector housings when the connector housing is in the closed engaged position.

The connector arrangement therefore permits a pivotal movement of the connector housing so that the latter will be arranged in the contact-engaging position on the electrical device.

The electrical device is preferably made in a planar manner, such as a compact plate or a printed circuit board. A subassembly, made as a printed circuit board, can be made in a manner where it will be charged or not charged with electrical components. Also preferred, moreover, are single-layer and multilayer printed circuit boards. Bus bars or bus grids are preferred as contact plates.

The connector contacts include at one end tulip shaped contacts for engagement with the planar contacts on the printed circuit board, and further preferably include on their other ends electrical connections for the connection of the conductors, such as, for example, terminal screws, spring terminals, and/or insulation terminals. It is preferred that the electrical contacts of the electrical device will in an electrically conducting manner contact the electrical contacts of the connector arrangement in the closed engaged position, but in the open disengaged position of the connector housing, the contacts are disengaged in a non-conducting manner. In this way, one can make sure that in the open disengaged position, even when working with a current conducting device, there will be a current-less reconfiguration of the electrical conductors.

In order to protect the operator, it is also preferred that the connector arrangement be mounted in an electrically insulating connector housing. For the same reason, it is also preferred that the main housing be made in an electrically insulating manner. And furthermore, the main housing preferably should overlap, at least partially, the connector housing. As a result, there is very little danger that the operator might touch current conducting parts of the connector arrangement when working with a current-conducting connector arrangement.

As a result of the locking of the connector housing to the main housing by means of the catch member, it will be assured that also under vibration stress, the connector arrangement will not be unintentionally separated from the installed engaged position. Instead, for locking purposes and possibly also for preparation purposes, the active manual actuation of the slide member by the operator is required. Therefore, it is ensured that the electrically conducting connection will be maintained between of the electrical contacts of the connector assembly to the electrical contacts of the printed circuit board.

In a preferred embodiment, the locking connection includes an attachment arm upon which a locking catch is arranged and which can be reversibly deflected into an attachment direction so that the attachment arm, and therefore along with it the locking catch, will be reversibly adjusted from the basic position into the attachment position. Furthermore, on the slide member, a guide slot is provided which receives a bolt that is arranged on the attachment arm. During the longitudinal shifting of the slide member, the bolt is guided along the slot. Furthermore preferred, there is provided on the slide a first rear ramp which, during the shifting of the slide member in an actuation direction, so cooperates with a support means, in particular, a fixed ledge on the connector housing, in such a way that the slide member will be laterally shifted in the locking direction. As a result, the slot is shifted, and because the bolt is guided within the slot, as a result, the bolt is also shifted in the locking direction, and along with it will also be the attachment arm and the catch.

A locking of the plug-in connection is therefore possible in a very simple and safe manner in the installation position of the plug-in connection in which the slide is shifted in the actuation direction.

In a particular preferred embodiment, the attachment arm is arranged individually on the connector device or on the connector housing. In this embodiment, the deflection is accomplished by bending the resilient attachment arm.

To release the locking arrangement, it is preferred that the slide member furthermore have a second inclined ramp surface which, during the displacement of the slide toward the withdrawn disengaged position, will so cooperate with the guide bolt that the attachment arm will be pivoted in the unlocking direction. In a preferred manner, this second front ramp is arranged generally parallel to the first ramp surface. When the slide member is withdrawn toward the disengaged position, the attachment arm is therefore actively reset. Because an active resetting of the slide member is required, this locking device will not be released by itself under vibration stress.

It is furthermore preferred that the slide member contain a passageway that is provided for the engagement of the actuation tool in order to make it simpler for the operator to release the lock.

The pivot axis is preferably arranged on a pivot side of the connector arrangement that faces away from the attachment arm in order to make use of the lever action during release, whereby the operator, in a particularly simple manner, can release the connector device from engagement with the printed circuit board.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
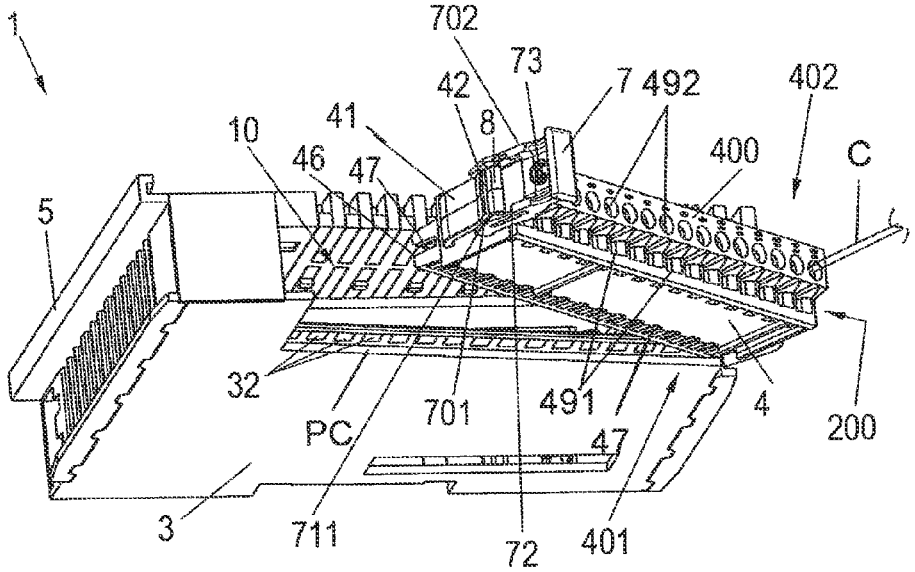
FIG. 1 is a bottom perspective view of the connector arrangement of the present invention with the connector housing pivoted toward the fully disengaged position.

Referring first more particularly to FIG. 1, the connector arrangement of FIG. 1 is designed to connect electrically the bare ends of a plurality of insulated conductor C with the contacts 32 of a printed circuit board PC that is mounted in a chamber contained in the side portion of a main housing 5. To this end, use is made of a connector device 4 arranged in connector housing 400 that is pivotally connected at a first end 200 by pivot means 50 for successive pivotal movement about vertical pivot axis 20 (FIG. 2) between the disengaged position of FIG. 1, the partially engaged position of FIG. 2, and the fully engaged position E of FIGS. 3 and 4. The connector device 4 carries a plurality of connector contacts 47 arranged in a longitudinal row for electrical engagement at one end with the corresponding contacts 32 arranged in a longitudinal row on the adjacent edge of the printed circuit board PC. Preferably, on the contact side 401 of the connector housing, the ends of the connector contacts 47 have a customary tulip-shaped configuration for connection with the planar contacts 32 of the printed circuit board. At their other ends 492 at the conductor side 702 of the connector housing, the connector contacts 47 are provided with conventional screw fastener means 491 for connection with the bare ends of insulated conductors C, respectively. Consequently, when the connector housing 400 is pivoted toward the fully engaged position of FIG. 3, the conductors C are respectively connected with the printed circuit contacts 32 by the connector contacts 47.

Figure 3:
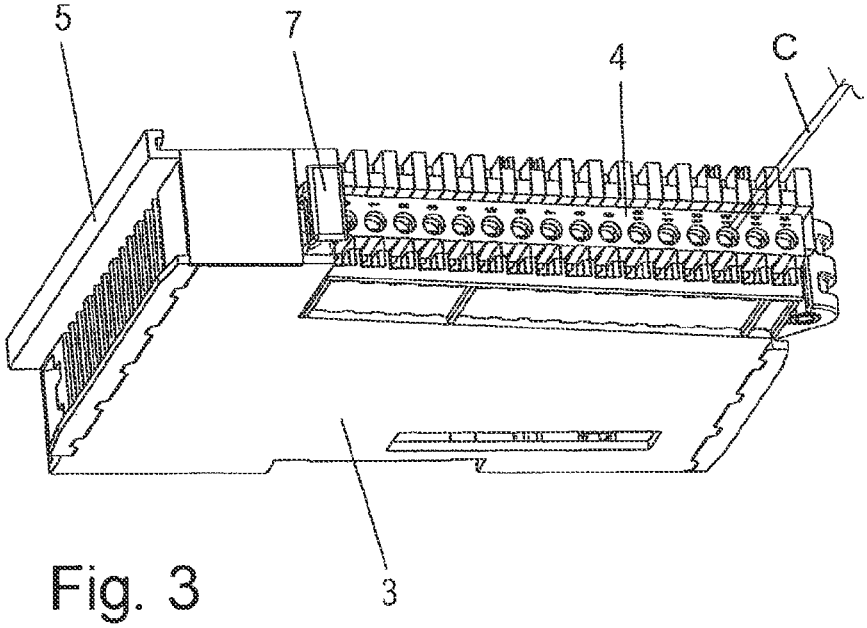
Figure 4:
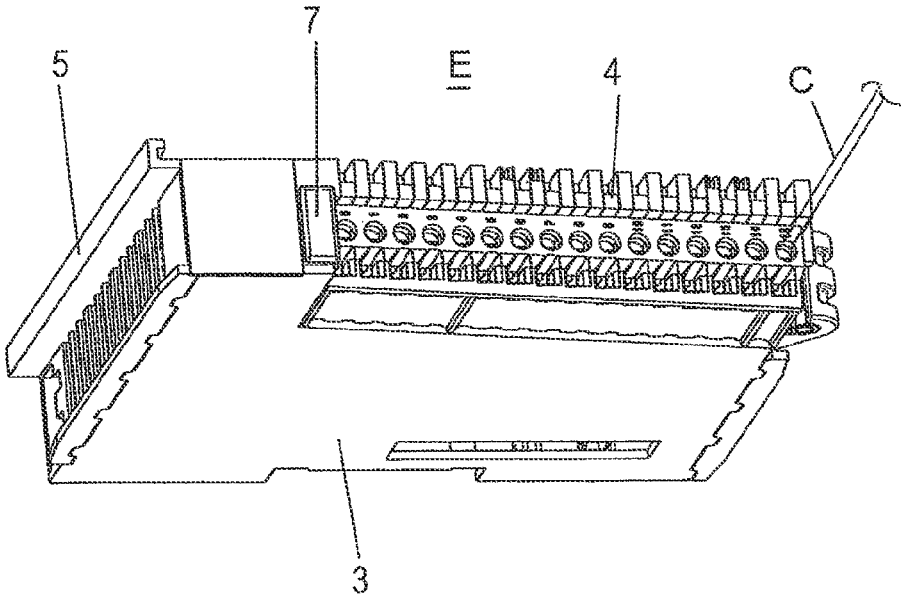
FIG. 4 is a corresponding view with the slide member inserted toward the fully locking position.
Figure 5:
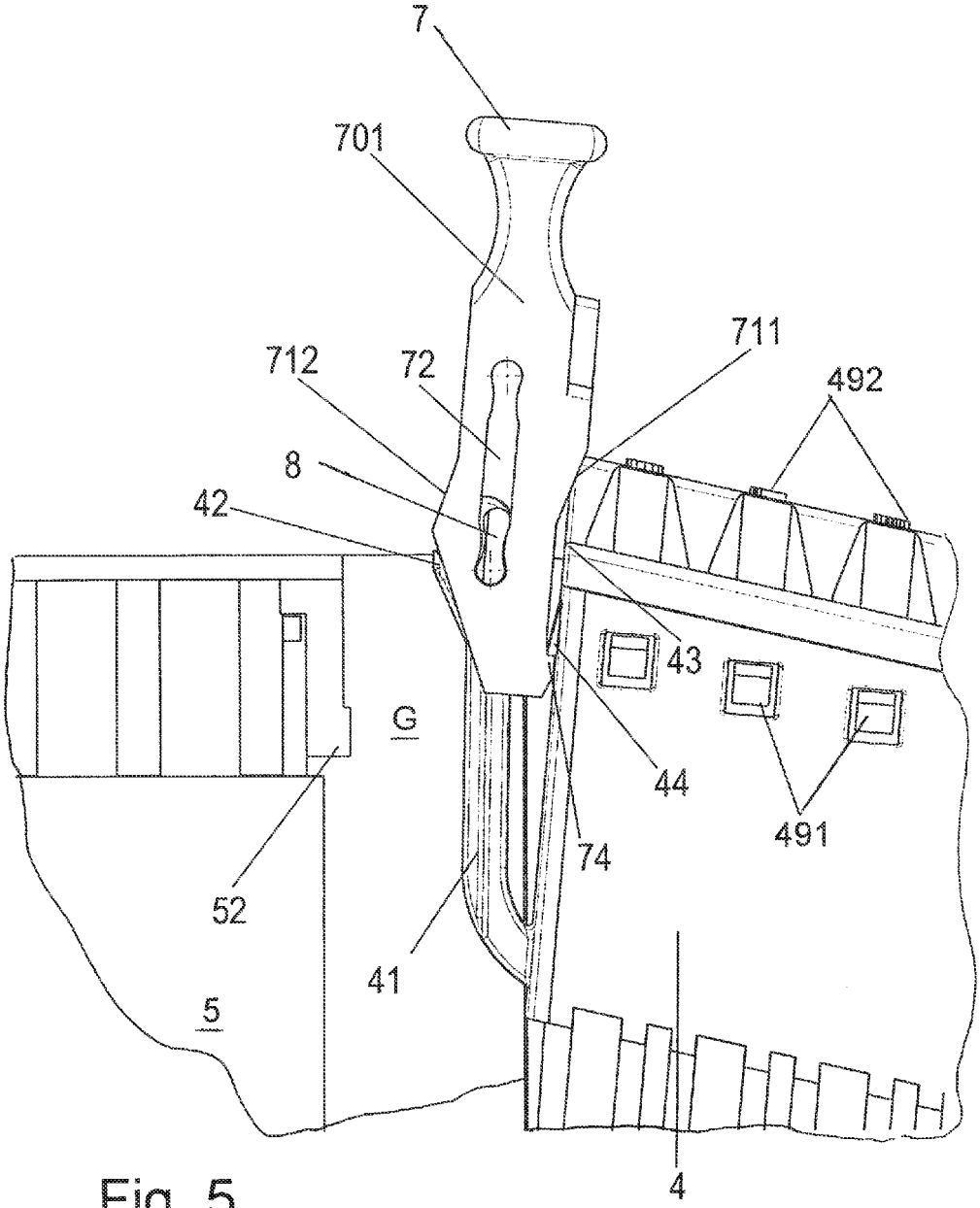
FIGS. 5-7 are detailed bottom views of the component locking means, with certain parts removed, of the slide member in the fully-withdrawn unlocking, partially-inserted, and fully-inserted locking positions, respectively.

According to a characterizing feature of the invention, manually operable locking means are provided for locking the connector housing 400 to the main housing 5 when the connector housing is in the engaged position of FIG. 3. These locking means include a slide member 7 that is arranged for transverse sliding displacement on the second end of connector housing 400. The slide member 7 includes a pair of parallel spaced side walls 701 and 702 that contain opposed guide slots 72. These guide slots receive the end portions of a transverse bolt 8 that is mounted on the free end of a resilient attachment arm 41 that is connected at its other end with the connector housing 400, as shown in FIG. 5. Also mounted on the free end of attachment arm 41 is a locking catch 42 that extends outwardly in a direction away from the connector housing 4, as best shown in FIGS. 5-7.

Figure 2:
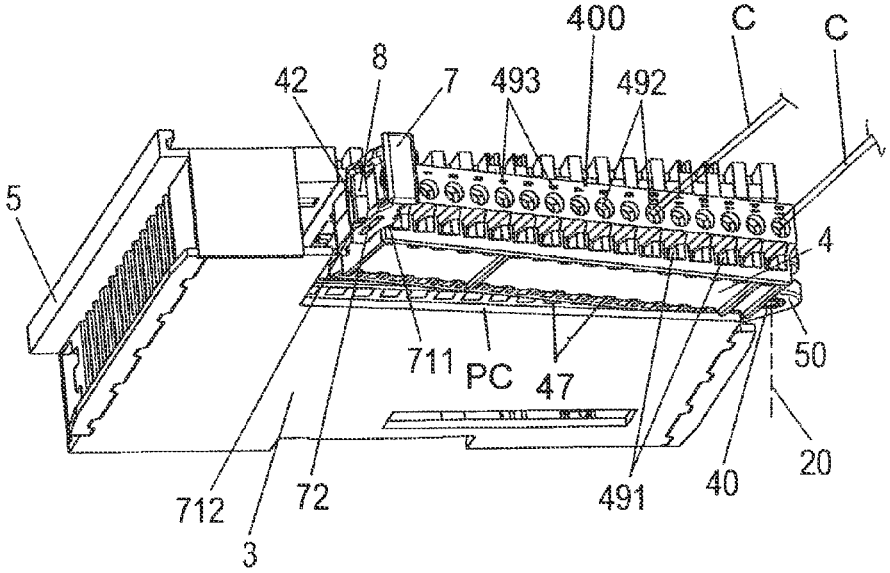
FIGS. 2 and 3 are corresponding views with the connector housing in partially closed and fully closed unlocked positions, respectively.

Assume that the connector housing 400 has been pivoted to the engaged position of FIGS. 3, 4, 6 and 7, and the slide member 7 is in the fully extended unlocking position T of FIGS. 1, 2, and 5. As shown in FIG. 5, further outward displacement of the slide member 7 is prevented by the cooperation between stop catch 44 on the connector housing 4 and a corresponding stoop catch 74 on the slide member. As catch member 74 is progressively inserted toward the intermediate position of FIGS. 3 and 6, a first inclined ramp surface 711 on the slide member 7 engages the fixed support ledge 43 on the connector housing 4, whereupon slide member is shifted laterally away from the connector housing 4, thereby causing displacement of bolt 8, attachment arm 41, and locking catch 42 toward the projection 52 on the main housing 5. When these components reach the locking position Z of FIG. 7, catch 42 is positioned in locking engagement B with projection 52, thereby locking the connector housing 4 to the main housing 5.

Figure 6:
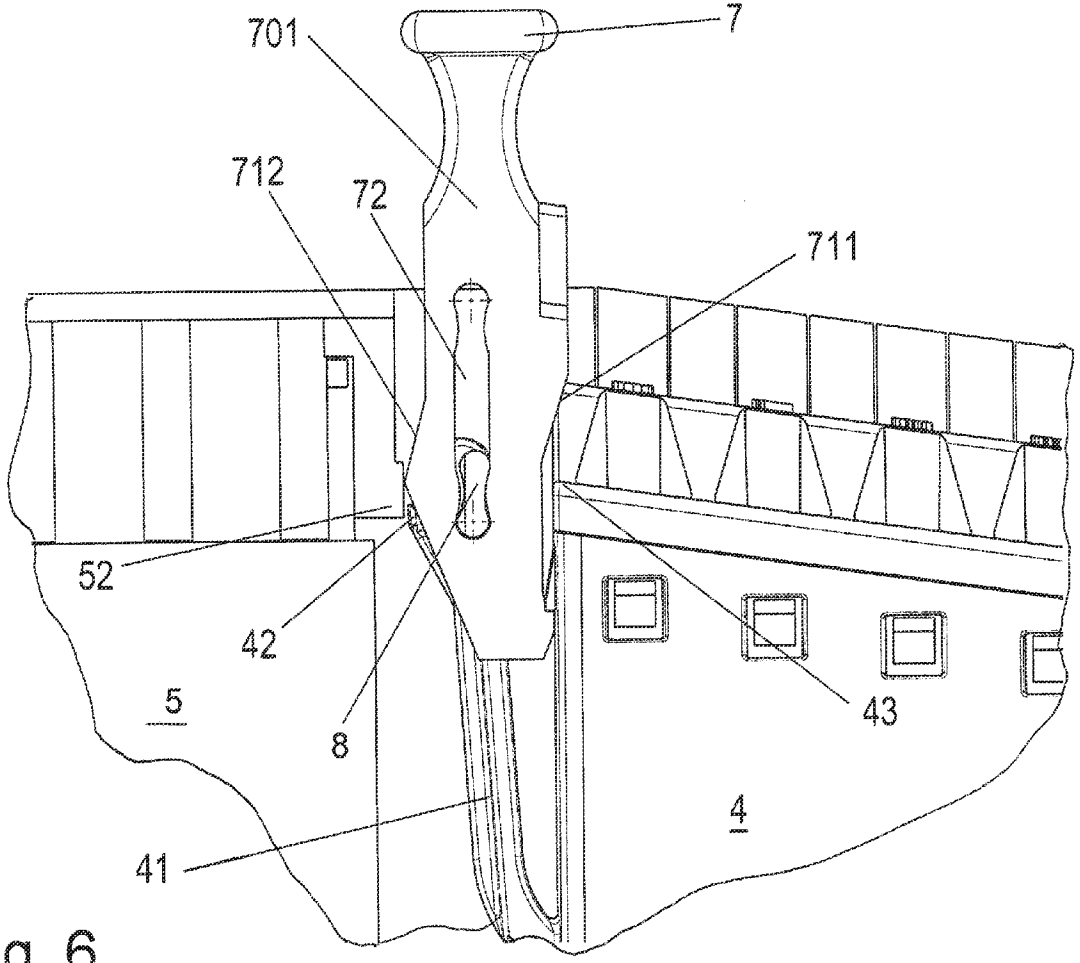
Figure 7:
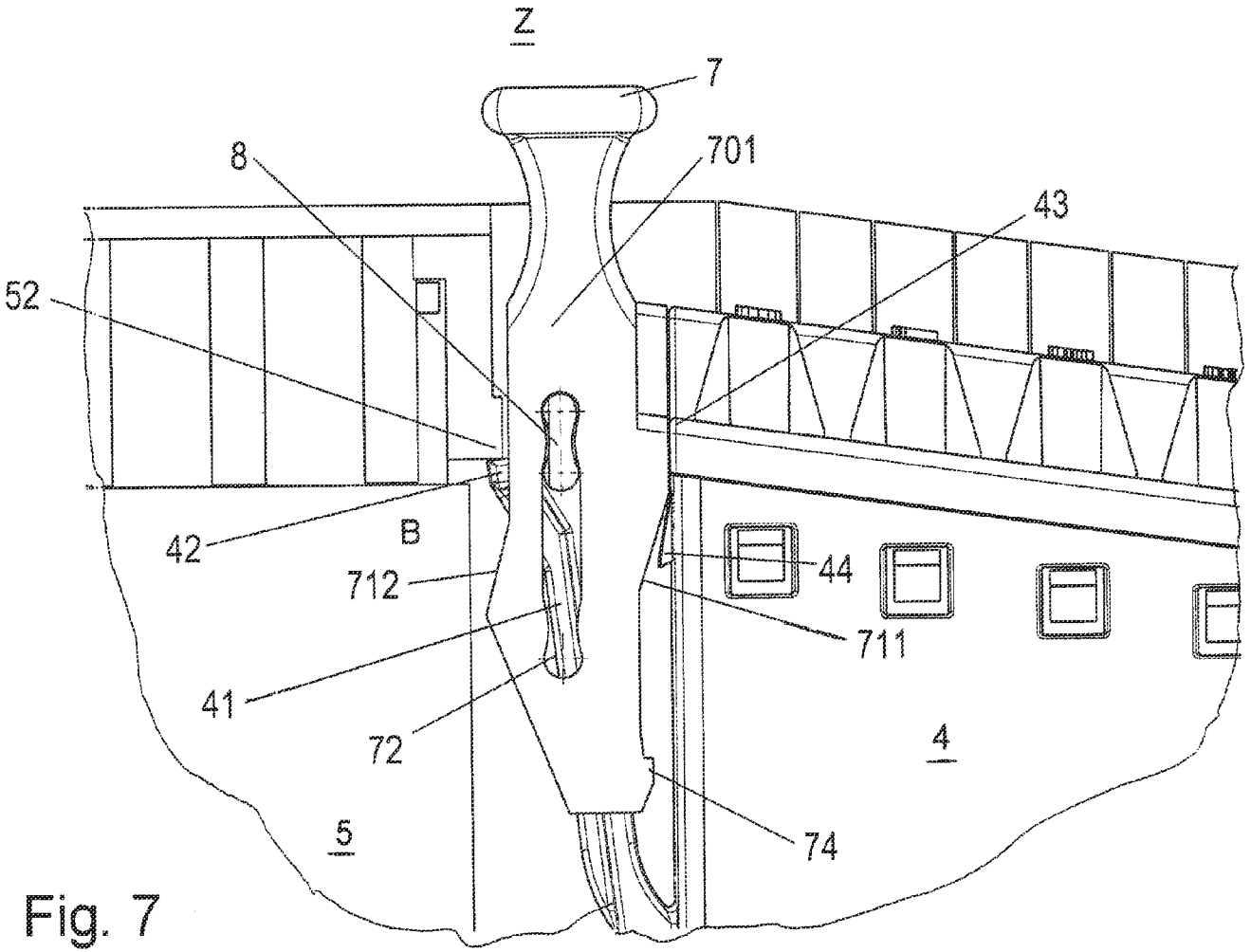

To unlock the housings, the sliding member is withdrawn outwardly toward the position of FIG. 6, whereupon the second inclined ramp surface 712 on the opposite side of the slide member engages the fixed locking projection 52, thereby displacing slide member 7 to the right to cause transverse bolt 8, the upper end of attachment arm 41, and the locking catch 42 to be displaced from the projection 52 toward its initial position G, whereupon the connector housing 400 is unlocked from the main housing 5. Further manual displacement of the slide member produces pivoting motion of the connector housing 400 toward the disengaged position of FIGS. 1 and 5.

It is to be noted that instead of a printed circuit board, other electrical devices could be used as well for example, contact plates as well as bus bars or bus grids. Furthermore, it is also possible to provide less or more electrical connections 491 as electrical contact 47, connecting them differently with each other and/or providing electrical parts (not shown) in connector device 4. For connection of the electrical conductors, one can consider various electrical connections 491, for example, terminal screws, spring terminals, insulation terminals, or others. For the electrical contact 47, it is preferred to provide sockets, for example, contact bells. But one can also consider plugs.

It can also be seen that the electrical contacts 491 in this case are made as screw terminals, because the connector device 4 on the connection side displays actuation openings 492 for the screw terminals. Furthermore, it can be seen that the electrical contacts 492 in each case display markings 493.

To protect the operator, connector device 4 has a housing 400 is formed of an electrically insulating material upon which are arranged its electrical contacts 491 and contacts 47. The pivot shaft 40 is shaped individually and solidly with the connector housing 400 in a particularly preferred manner consisting of a synthetic substance. Of course, the connector housing 400 could be formed integrally with the connector device 4. Bolt 8 is arranged on attachment arm 41 and is preferably made in one piece with it. Finally, an opening 73 is provided in slide member 7 for facilitating the actuation of slide member 7 by an operating tool, such as a screwdriver.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector arrangement for connecting a plurality of conductors (C) with the contacts (32) of an electrical device (PC), comprising:

(a) a main housing (5) having first and second ends, said main housing having a side portion containing a chamber;

(b) an electrical device (PC) mounted in said main housing chamber, said electrical device having a horizontal row of first electrical contacts (32) extending longitudinally between said housing first and second ends;

(c) a connector housing (400) having a first end portion pivotally connected with said main housing first end for pivotal movement about a vertical pivot axis (20), thereby to afford pivotal displacement of said connector housing between engaged and disengaged positions relative to said main housing, said connector housing having a second end;

(d) a connector device (4) carried by said connector housing, said connector device having a longitudinal row of conductor contacts (47) having first ends arranged for electrical engagement with said first contacts, respectively, when said connector housing is in said engaged position; and (e) locking means for locking said connector housing to said main housing when said connector housing is in said engaged position, said locking means including:

(1) a rigid locking projection (52) mounted on said main housing adjacent said connector housing second end;

(2) a catch member (42) movably connected with said connector housing second end adjacent said rigid projection, said catch member being displaceable longitudinally of said connector housing between locked and unlocked positions relative to said rigid locking projection; and (3) manually-operated actuator means (7) for displacing said catch member between said locked and unlocked positions.

2. A connector arrangement as defined in claim 1, and further including an attachment arm (41) connecting said catch member for displacement longitudinally of said connector housing, said attachment arm having a first end connected with said connector housing, and a second end connected with said catch member.

3. A connector arrangement as defined in claim 2, wherein said actuator means includes a slide member (7), and connecting means including a guide slot (72) and a guide bolt (8) connecting said slide member with said actuating arm for sliding movement between locking and unlocking positions in a direction generally transverse to the longitudinal axis of said connector housing.

4. A connector arrangement as defined in claim 3, wherein said slide member includes a first side having a first inclined ramp surface (711) arranged to engage a fixed support ledge (43) on said connector housing during displacement of said slide member from said unlocking position toward said locking position, thereby to displace said slide member laterally to displace said attachment arm second end and said catch member away from said connector housing toward said locked position.

5. A connector arrangement as defined in claim 4, wherein said slide member includes a second side opposite said first side including a second inclined ramp surface (712) arranged to engage said main housing fixed projection during displacement of said slide member from said locking position toward said unlocking position, thereby to displace said slide member laterally to displace said attachment arm second end and said catch member toward said unlocked position.

6. A connector arrangement as defined in claim 5, wherein said attachment arm is resilient.

7. A connector arrangement as defined in claim 5, and further including stop means (44; 74) limiting the extent of displacement of said slide member in the unlocking direction.

8. A connector arrangement as defined in claim 1, wherein each of said conductor contacts includes a second end portion provided with a screw terminal (491) for connection with the bare end of an insulated conductor (C), respectively.

9. A connector arrangement as defined in claim 8, wherein said conductor contact first ends are generally tulip-shaped; and further wherein said electrical apparatus contacts are generally planar.

10. A connector arrangement as defined in claim 1, wherein said connector housing partially extends into said main housing chamber when said connector housing is in said engaged position.

* * * * *